US006074261A

United States Patent [19]

Jougla

[11] Patent Number: 6,074,261

[45] Date of Patent: Jun. 13, 2000

[54] INFLATABLE PNEUMATIC ENCLOSURE WITH CONSTRAINED GEOMETRIC SHAPE, IN PARTICULAR FLAT, ESPECIALLY FLOOR FOR CRAFT

[75] Inventor: Daniel Jougla, Labege, France

[73] Assignee: Zodiac International, Issy les Moulineaux, France

[21] Appl. No.: 09/299,368

[22] Filed: Apr. 26, 1999

[30] Foreign Application Priority Data

Apr. 29, 1998 [FR] France ..... 98 05392

[51] Int. Cl.[7] ..... B63B 35/58

[52] U.S. Cl. ..... 441/41

[58] Field of Search ..... 114/345; 441/35, 441/40, 41, 96, 99

[56] References Cited

U.S. PATENT DOCUMENTS

| | | | |
|---|---|---|---|
| 2,912,033 | 11/1959 | Neisler . | |
| 2,998,022 | 8/1961 | Russel . | |
| 4,478,587 | 10/1984 | Mackal | 441/41 |
| 4,927,397 | 5/1990 | Yeager | 441/41 |

FOREIGN PATENT DOCUMENTS 2379001 8/1978 France .

OTHER PUBLICATIONS

French Preliminary Search Report dated Jan. 5, 1999 (2 pages).

*Primary Examiner*—Stephen Avila
*Attorney, Agent, or Firm*—Dean W. Russell; Kilpatrick Stockton LLP

[57] ABSTRACT

An inflatable pneumatic enclosure 1 of constrained geometric shape, comprising two main walls 2, 3 held the one relative to the other, in the inflated state of the enclosure, in a pre-specified relative position by a multiplicity of flexible links 4 interposed between said walls 2, 3, an inflation valve 6 being fixed in one of said walls 2 for the inflation of the enclosure, characterised in that the valve 6 is of the embedded or semi-embedded type with a valve body 7 extending inside the enclosure 1 under said mounting wall 2 and in that a spacing body 8 extends between the valve body 7 and the opposite wall 3 of the enclosure and is fixed to these, said spacing body 8 being dimensioned so that the two aforementioned walls 2, 3 are held in a desired relative position in relation to that obtained by the surrounding flexible links.

12 Claims, 1 Drawing Sheet

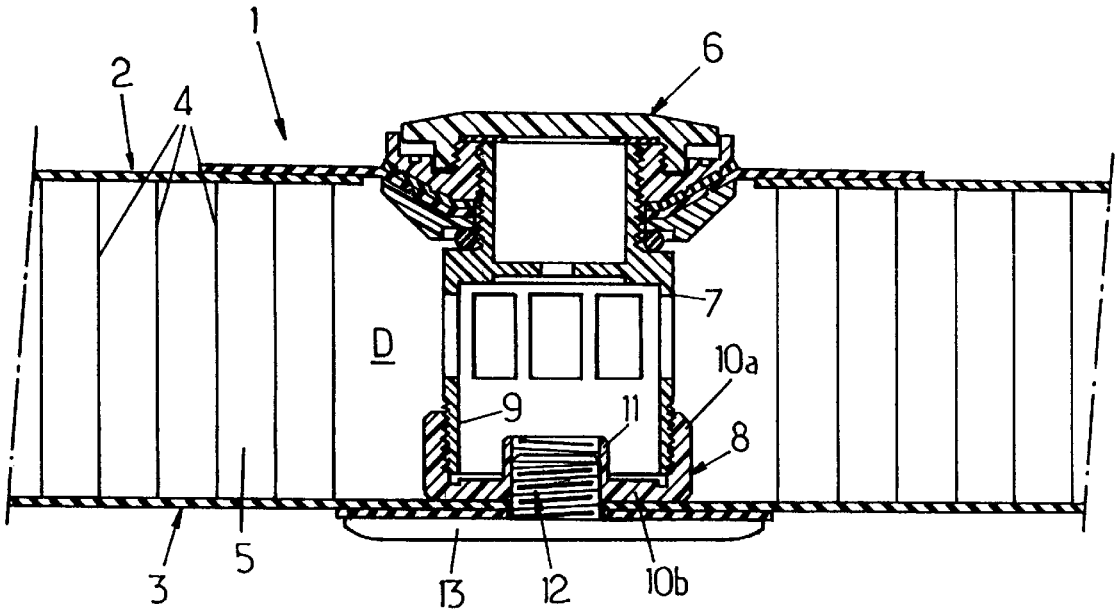
figure

INFLATABLE PNEUMATIC ENCLOSURE WITH CONSTRAINED GEOMETRIC SHAPE, IN PARTICULAR FLAT, ESPECIALLY FLOOR FOR CRAFT

The present invention concerns improvements made to inflatable pneumatic enclosures of constrained geometric shape, comprising two main walls held one relative to the other, in the inflated state of the enclosure, in a pre-specified relative position by a multiplicity of flexible links interposed between said walls, an inflation valve being fixed in one of said walls for the inflation of the enclosure.

Such an enclosure can for example be made as a flat shaped enclosure, for example to constitute an inflatable craft floor, in particular a dinghy floor.

Thus, an inflatable floor under high pressure for a pneumatic craft is composed of two fabric layers (forming said main walls) made watertight by a plastomer, elastomer or other coating and connected together by threads perpendicular to the two layers. These threads enable the two parallel layers to be held once the floor is inflated. The assembly is cut out in the shape of the bottom, then assembled so as to be watertight over the entire perimeter by tight contact with the inflatable buoyancy fender and the craft transom.

The internal part containing the connecting threads between the two layers is inflated under high pressure so as to give the floor a rigidity equivalent to that of a rigid material floor (wood, plywood, composite or other).

Two inflation valve arrangements are currently used for the fitting out of inflatable floors:

1. An embedded or semi-embedded valve has its valve body extending inside the floor, which makes it necessary to cut a large number of the connecting threads to enable the valve body to be placed between the layers.

As a result:

- the zone is weakened because the threads, near to these cuts, work over-stressed and can break causing a chain rupture and the bursting of the floor; to avoid this, it may be necessary to reduce the inflation working pressure and through this the rigidity of the floor, or indeed to mechanically over-size the threads, which makes the floor more expensive;
- the lower layer opposite to that fixing the valve, no longer being held locally, forms an unsightly bulge, which deforms the floor and is liable to abrasion.

2. A projecting valve can be placed by cutting a minimum of connecting threads and therefore does not have the aforementioned disadvantages, but protrudes on the upper layer of the floor with the corresponding disadvantages (the risk of catching the feet or of tearing it out with badly stowed loads, etc).

The aim of the invention is therefore mainly to remedy the aforementioned disadvantages of currently known technical solutions and to propose, to do this, an improved arrangement which allows an embedded or semi-embedded valve to be used without resulting in a local weakening of the enclosure, particularly of the inflatable floor, and without resulting either in any appreciable additional expenditure, or in additional difficulty in mounting or maintenance.

To this end, an inflatable pneumatic enclosure as aforementioned is characterised, being arranged according to the invention, in that the valve is of the embedded or semi-embedded type with a valve body extending inside the enclosure under said mounting wall and in that a spacing body extends between the valve body and the opposite wall of the enclosure and is fixed to these, said spacing body being dimensioned so that the two aforementioned walls are held in a desired relative position in relation to that obtained by the surrounding flexible links.

To advantage, to obtain an optimum compensation of the forces and so that no discontinuity remains in the connection between the two layers or flexible walls, the spacing body has a transverse section approximately identical to that of the valve body.

Preferably, the spacing body is fixed by screwing to the valve body, so as to simplify to the maximum the assembling of the various components.

In a preferred version, the lower end of the valve body is of cylindrical revolution and is provided with an external thread and the corresponding end of the spacing body is shaped as a hollow socket provided with an internal thread suitable to engage by screwing with the end of the valve body. In the same way, it is desirable that the spacing body is fixed to the opposite wall by a screw engaged through this; preferably then the screw has a head, outside said opposite wall, which has a transverse dimension approximately at least equal to that of the spacing body, so that the lower layer is appropriately retained; it is also desirable that the screw head is very flat and forms only a small projection on the opposite wall, in order that there does not exist any noticeable excrescence capable of obstructing, or even damaging, for example by wear, the enclosure placed on a support and/or the support itself.

The improved arrangement which has just been described can find a particularly attractive application in the case of a pneumatic enclosure of flat geometric shape with its two lower and upper walls held approximately parallel to one another, in particular to constitute an inflatable pneumatic floor of a dinghy.

It will be noted in this respect that the installed valve, notwithstanding the provision of an external thread on the end of the valve body, is quite able to be used moreover independently from the spacing body. Thus said valve can be used for example to equip the inflatable buoyancy fender of the craft. There is no need therefore to provide, to implement the invention, a specific type of valve which would have been expensive, and it is sufficient to introduce a minor and inexpensive adjustment to the valves currently used.

By means of these arrangements according to the invention, the obtained assembly provides:

- a semi-embedded valve function without noticeable projection,
- continuity of take up of the mechanical forces in the valve fixing zone,
- good aesthetic quality due to the flatness and the parallelism of the two layers restored in this zone despite the cutting of the connecting threads.

The invention will be better understood by reading the detailed description which follows of a preferred version given only as a non-restrictive example. In this description, reference is made to the appended drawing in which the single FIGURE is a sectional view of a part of an inflatable pneumatic enclosure arranged according to the invention.

In this FIGURE, the inflatable enclosure designated in its assembly by the reference numeral 1 includes two main flexible walls, respectively upper 2 and lower 3, which can be layers of fabric made watertight by a plastomer, elastomer or other coating, and which are connected together by a multiplicity of flexible links 4, such as threads, which, when the internal volume 5 of the enclosure is inflated under pressure, extend approximately perpendicularly to the layers 2 and 3 and hold them approximately parallel to one another. Each layer can be of multi-layer composition, with at least one gas tight layer and one coating layer for the fixing of the ends of the threads. The arrangement of such an enclosure is known professionally and does not have to be developed here.

This enclosure is provided with an inflation valve 6 which is fixed on the flexible upper wall 2 and which is of the embedded or semi-embedded type; in other words, the valve body 7 is located, either totally or partly, under the upper wall 2 and inside the volume 5 of the enclosure. The appropriate composition of the valve and its mounting method on the flexible wall 2 are without direct relation with the invention.

To enable the installation of the valve 6, it is necessary that the threads 4 are removed in an area D the dimension of which is at least equal to the transverse dimension of the valve body 7.

Between the valve body 7 and the lower flexible wall 3, a spacing body 8 is interposed which is fixed both to the valve body 7 and to the lower wall 3 and which is of a height suitable for the walls 3 and 2 to be fixed to one another at right angles to the valve and to be held approximately parallel to one another. Thus, by means of the presence of this spacing body 8, the valve 6 can be made to perform the additional function of a connection between the two walls 2 and 3 in place of the flexible links 4 which have been removed to allow its presence.

Consistent with, it is convenient that between, on the one hand, the rigid connection obtained by the valve 6 and the spacing body 8 which is associated with it and, on the other hand, the flexible links 4 which surround it, there only remains a minimal gap which is not liable to cause an appreciable deformation of the flexible wall 2 and/or 3: it is thus desirable that the spacing body 8 has a transverse dimension approximately equal to that of the valve body 7 so as to geometrically extend it.

In order that the connections of the spacing body 8 with the valve body 7 and with the lower flexible wall 3 are reliable over time, it is desirable that these connections are made by screwing.

Thus, according to the preferred version illustrated in the single FIGURE, provision can be made for the lower end of the valve body 7 to be of cylindrical revolution and to be provided with an external thread (in the example shown, the thread is provided on an annular skirt 9 which extends the casing housing the valve mechanism itself. Regarding the spacing body 8, its corresponding end is shaped as a hollow socket 10 the lateral wall 10*a* of which is internally threaded, to screw onto the threaded end of the valve body 7. Of course, an inverted arrangement (spacing body 8 fitted inside the skirt 9) is conceivable; in the same way, other connection means (ratchet particularly) can be provided in place of the screwing means.

Thus, it is the choice of thickness of the bottom 10*b* of the hollow socket constituting the spacing body which enables the joining of the walls 2 and 3 approximately parallel to one another.

Furthermore, the spacing body 8 can be provided with a central bore (for example in the shape of a central hub 11 in the case of the illustrated hollow socket) which is internally threaded to receive a locking screw 12 passing through the lower flexible wall 3. Preferably, to obtain a good hold of the tensioned flexible wall 3, the head 13 of the screw 12 has a transverse dimension at least equal to, indeed greater than the transverse dimension of the bottom 10*b* of the spacing body 8.

Moreover, in order that the enclosure 1 can rest on a level support without damaging it and without the lower wall 3 being noticeably deformed, the head 13 of the screw 12 is made very flat and only forms a small projection on the wall 3.

By means of the arrangements of the invention, continuity is provided in the mechanical connections of the two walls 2 and 3 at right angles to the inflation valve 6. This mechanical connection at right angles to the valve is obtained by using simple means, amongst which the valve itself is brought to play a role. By providing a range of several spacing bodies 8 having different thicknesses, it is possible, with the same valve, to provide effective spacing adaptable to these enclosures 1 having varied thicknesses. The two components (spacing components 8 and locking screw 12) to be attached to the valve 6 can be manufactured in a moulded plastic material, at low cost, and the cost of the assembly can be not much more than that of the valve alone.

It will be noted that the means (spacing pieces and locking screw) attached to the valve affect neither the valve structure nor its functioning mode in other words, the valve 6 provided with its skirt 9 extending the valve body 7 can be used alone where a spacing function is not required. Thus the valve 6 can equally well be used alone on an inflatable body of non-constrained geometric shape with a traditional mounting method, or indeed in conjunction with the aforementioned spacing means on an inflatable body of geometric shape constrained by the presence of spacing links.

It will also be noted that the means used within the framework of the invention to provide the mechanical connection between the valve body 7 and the lower flexible wall 3 are independent of the structure of the valve, as well as of its fixing method on the upper flexible wall 2. The invention can therefore find application in relation to all types of valve, requiring only a minor adjustment of the valve body for it to become suitable to be mechanically fixable to a spacing body 8 chosen in a selective manner. It is, furthermore, conceivable for already existing enclosures 1 to be adapted (adaptation of the valve body and drilling the lower flexible wall) to equip them according to the invention.

Finally, it will be noted that the proposed means within the framework of the present invention are suitable to equip any inflatable enclosure having a geometric shape constrained by means of internal connections. A very common application focuses, in practice, on flat shape enclosures with approximately parallel upper and lower main walls, in the approximate shape of a mattress. Such flat enclosures, inflated under high pressure, are used particularly as pneumatic floors to equip dinghies.

I claim:

1. An inflatable pneumatic enclosure of constrained geometric shape, comprising two main walls held the one relative to the other, in the inflated state of the enclosure, in a pre-specified relative position by a multiplicity of flexible links interposed between said walls, an inflation valve being fixed in one of said walls for the inflation of the enclosure, the valve being of the embedded or semi-embedded type with a valve body extending inside the enclosure under said mounting wall, and a spacing body extending between the valve body and the opposite wall of the enclosure and being fixed to these, said spacing body being dimensioned so that the two aforementioned walls are held in a desired position in relation to that obtained by the surrounding flexible links.

2. An inflatable pneumatic enclosure according to claim 1, in which the spacing body has a transverse section approximately identical to that of the valve body.

3. An inflatable pneumatic enclosure according to claim 1, in which the spacing body is fixed by screwing to the valve body.

4. An inflatable pneumatic enclosure according to claim 3, in which the lower end of the valve body is of cylindrical revolution and is provided with an exterior thread and in that the corresponding end of the spacing body is shaped as a hollow socket provided with an internal thread suitable to engage by screwing with the end of the valve body.

5. An inflatable pneumatic enclosure according to any one of the claims 2 to 4, in which the spacing body is fixed to the opposite wall by a screw engaged through this.

6. An inflatable pneumatic enclosure according to claim 5, in which the screw has a head, outside the opposite wall, which has a transverse dimension approximately at least equal to that of the spacing body.

7. An inflatable pneumatic enclosure according to claim 5, in which the head of the screw is very flat and only forms a small projection on the opposite wall.

8. An inflatable pneumatic enclosure constituted according to claim 1, in which it has, in the inflated state, a flat geometric shape with its two upper and lower walls held approximately parallel to one another.

9. An inflatable pneumatic floor under relatively high pressure particularly for a dinghy, characterised in that it is constituted according to claim 8.

10. An inflatable enclosure according to claim 1 in which the two walls form an inflatable chamber in which the entirety of the spacing body is positioned.

11. An inflatable enclosure comprising:

a. first and second walls, which walls define an inflatable chamber;

b. multiple flexible links interposed between the first and second walls to assist in holding at least part of the first wall in a predetermined position relative to the second wall when the enclosure is inflated;

c. an inflation valve fixed in the first wall and having a body extending into the inflatable chamber;

d. a spacing body (i) extending between and fixed to the valve body and second wall, (ii) defining a threaded bore, and (iii) dimensioned so that the first and second walls are held in a desired position approximately that of the predetermined position; and e. a locking screw passing through the second wall and received by the threaded bore.

12. An inflatable enclosure according to claim 11 in which:

a. the second wall has an exterior surface; and b. the locking screw has a flat head projecting minimally from the exterior surface of the second wall.

* * * * *